US008096211B2

(12) United States Patent
Cho et al.

(10) Patent No.: US 8,096,211 B2
(45) Date of Patent: Jan. 17, 2012

(54) DIGITAL POWER TORQUE WRENCH OF INDIRECT TRANSMISSION

(75) Inventors: Chih-Hua Cho, Nantou County (TW); Wei-Min Chen, Taichung County (TW); Wan-Lung Lee, Hsinchu County (TW); Hsin-Hung Lee, Taichung (TW)

(73) Assignee: Industrial Technology Research Institute, Hsin-Chu (TW)

( * ) Notice: Subject to any disclaimer, the term of this patent is extended or adjusted under 35 U.S.C. 154(b) by 230 days.

(21) Appl. No.: 12/100,006

(22) Filed: Apr. 9, 2008

(65) Prior Publication Data

US 2009/0165609 A1 Jul. 2, 2009

(30) Foreign Application Priority Data

Dec. 27, 2007 (TW) ..... 96150490 A

(51) Int. Cl.
*B25B 13/46* (2006.01)

(52) U.S. Cl. ..... 81/57.39; 81/467; 81/468; 81/469; 81/479

(58) Field of Classification Search ..... 81/57.39, 81/467, 468, 469, 479
See application file for complete search history.

(56) References Cited

U.S. PATENT DOCUMENTS 4,544,039 A 10/1985 Crane
4,722,252 A * 2/1988 Fulcher et al. ..... 81/57.39
5,315,501 A * 5/1994 Whitehouse ..... 700/32
5,351,555 A 10/1994 Garshelis
5,692,575 A * 12/1997 Hellstrom ..... 173/216
6,070,506 A * 6/2000 Becker ..... 81/479
2008/0127711 A1 * 6/2008 Farag ..... 73/1.11

OTHER PUBLICATIONS

Taiwan Intellectual Property Office, "Office Action", Jan. 23, 2011, Taiwan.

* cited by examiner

*Primary Examiner* — Joseph J Hail
*Assistant Examiner* — Shantese McDonald
(74) *Attorney, Agent, or Firm* — WPAT., P.C.; Justin King

(57) ABSTRACT

The present invention relates to a digital power torque wrench of indirect transmission, which is composed of an eccentric driving module, a sensing module, a ratchet module and a control module. The eccentric driving module is used for transmitting power to the sensing module and the ratchet module for driving the ratchet module rotate accordingly and thus transferring the momentum of the rotating to fasten a workpiece, such as a bolt or nut. The sensing module is capable of detecting the deformation of the ratchet module as it is rotating against an increasing resistance during the fastening process, and converting the detected deformation into a signal to be received by the control module. The control module is capable of quantifying the signal for converting the same into a numerical signal representing a torque detected by the sensing module and then sending the numerical signal to a display device for displaying. With the aforesaid digital power torque wrench of indirect transmission, not only the detection can be achieved in a rapid manner without being troubled by wear-and-tear and noise, but also it is ease to maintain and can be manufactured with comparatively less cost.

19 Claims, 3 Drawing Sheets

DIGITAL POWER TORQUE WRENCH OF INDIRECT TRANSMISSION

FIELD OF THE INVENTION

The present invention relates to a digital power torque wrench of indirect transmission, and more particularly, to a torque wrench capable of using a sensing module to detect the deformation of a workpiece while converting the detected deformation into an electric signal to be received by a control module where it si quantified into a torque-representing numerical signal.

BACKGROUND OF THE INVENTION

Generally, a common torque wrench, used for fixing workpieces such as nuts, blots and washers, has no way of knowing whether or not the workpieces are properly tightened except by user's feeling. Since there is no quantitative data provided by the common torque wrench about the force it is exerting, it is impossible for the user to know exactly whether or not the workpiece is already over tightened or is still loose, so that there is always a safety precaution or doubt about the use of those common torque wrenches. Therefore, more and more torque wrench with torque indication are developed, such as torque wrenches with indicator-type or digital display torque meter, or digital power torque wrenches, etc.

There are two types of digital power torque wrenches, which are contact type and non-contact type. The contact type digital power torque wrenches can be exemplified by a power torque wrench disclosed in U.S. Pat. No. 4,544,039, entitled "Torque transducing systems for impact tools and impact tools incorporating such systems", which is able to obtain and send a torque signal to a gauge by the detection of current using its slip rings and brushes. However, such contact type torque wrench usually has disadvantages such as slow detection, wear- and tear problems, noises, high manufacturing cost, and so on.

For the non-contact type digital power torque wrenches, they can be further divided into two categories which are electromagnetic torque wrenches and optical torque wrenches. The non-contact type electromagnetic torque wrenches can be exemplified by a power torque wrench disclosed in U.S. Pat. No. 5,351,555, entitled "Circularly magnetized non-contact torque sensor and method for measuring torque using the same", which is operating under the principle that: when the torque wrench is used for tightening a workpiece, the application is going to apply a torque upon its rotating shaft for causing the rotating shaft to deform slightly and thus producing a magnetic field variation in response to the deformation, and then such magnetic field variation is converted by its process control system into a numerical value as an indication of torque which is displayed on its liquid crystal display panel. However, although such non-contact torque wrench has fast detection speed and no wear-and-tear problem, it is still suffered by noise problems and high manufacturing cost.

Therefore, it is in need of a power torque wrench not only can perform a torque measurement in a rapid manner without being troubled by wear-and-tear and noise, but also it is ease to maintain and can be manufactured with comparatively less cost.

SUMMARY OF THE INVENTION

The object of the present invention is to provide a digital power torque wrench of indirect transmission, capable of not only performing a torque measurement in a rapid manner without being troubled by wear-and-tear and noise, but also capable of being maintained easily and manufactured with comparatively less cost.

To achieve the above object, the present invention provide a digital power torque wrench of indirect transmission, comprising: an eccentric driving module; a sensing module; a ratchet module; and a control module; wherein the eccentric driving module is used for transmitting power to the sensing module and the ratchet module for driving the ratchet module rotate accordingly and thus transferring the momentum of the rotating to fasten a workpiece; the sensing module is capable of detecting the deformation of the ratchet module as it is rotating against an increasing resistance during the fastening process, and converting the detected deformation into a signal to be received by the control module; and the control module is capable of quantifying the signal for converting the same into a numerical signal representing a torque detected by the sensing module and then sending the numerical signal to a display device for displaying.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
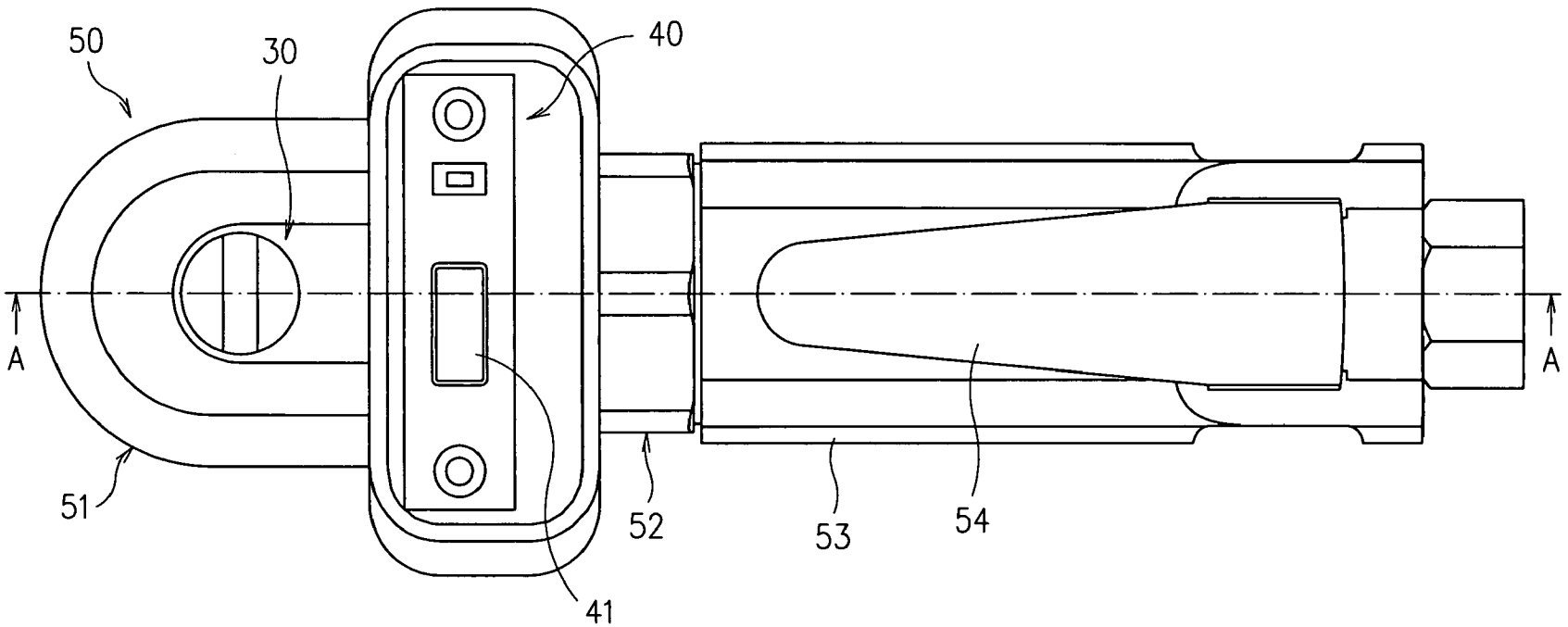
FIG. 1 is a top view of a digital power torque wrench of indirect transmission according to an exemplary embodiment of the invention.
Figure 2:
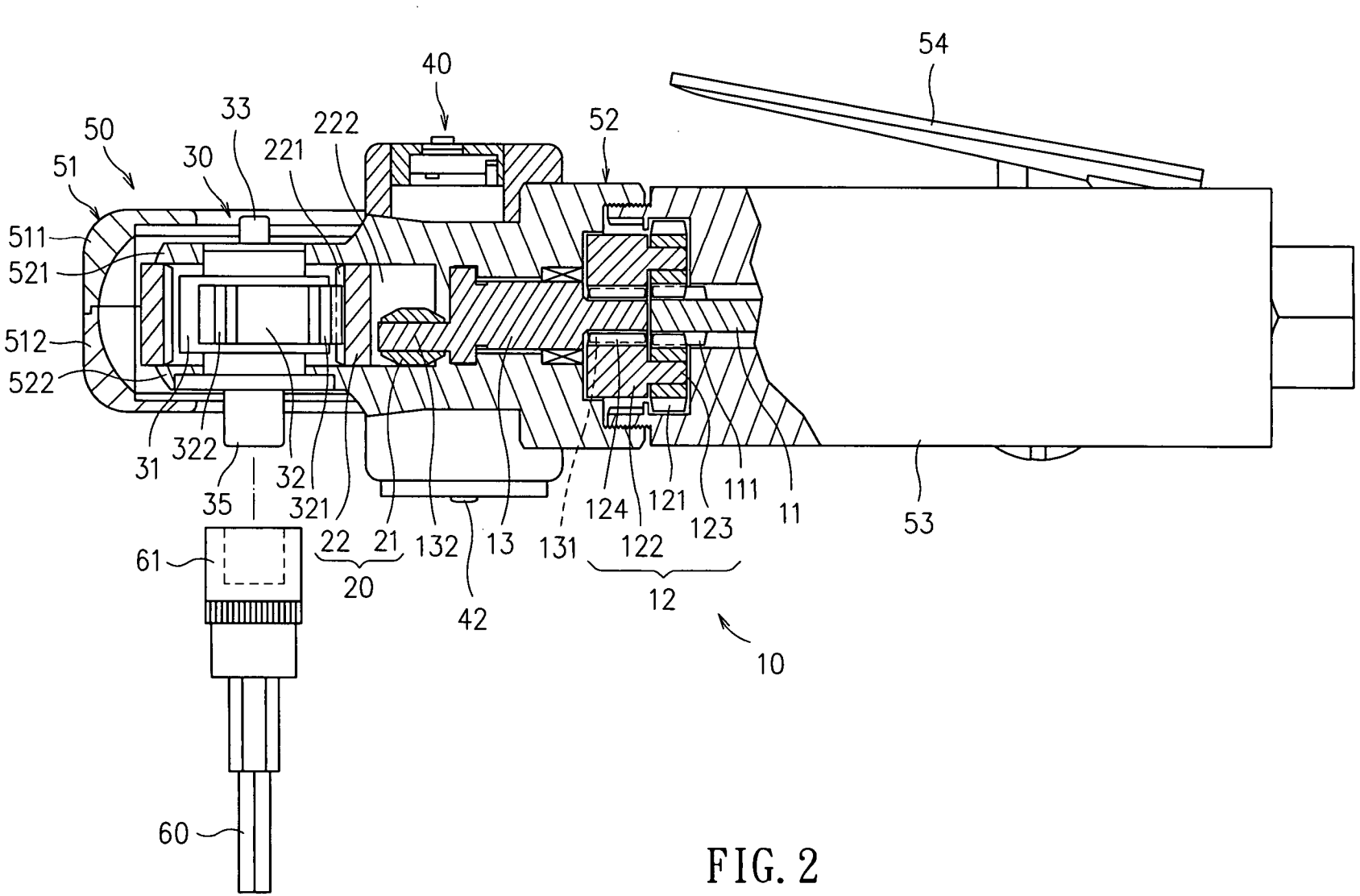
FIG. 2 is an A-A sectional view of FIG. 1.

Please refer to FIG. 1 and FIG. 2, which show a digital power torque wrench of indirect transmission of the present invention. The digital power torque wrench of indirect transmission is comprised of: an eccentric driving module 10, a sensing module 20, a ratchet module 30, a control module 40 and a shell 50. The shell 50 is used for receiving the eccentric driving module 10, the sensing module 20, the ratchet module 30 and the control module 40, which includes: an exterior shell 51 composed of an exterior top case 511 and an exterior bottom case 512; and an interior shell 52 composed of an interior top case 521 and an interior bottom case 522. In addition, the interior shell 52 is further fixedly screwed to a handle portion 53. In FIG. 1, there is a control switch 54 being configured on the shell 50 in a manner that it is electrically coupled to the control module 40 for control the inputting of power to the handle portion 53 of the torque wrench. It is noted that the power source of the torque wrench can be a pneumatic power system or an electric power system. Moreover, the control switch 54 is not limited to the press-button type switch and can be other types of switches known to those skilled in the art.

The eccentric driving module 10 is used for receiving power form a power source and thus transmitting the received power to the other portions of the torque wrench, which comprises: a transmission gear shaft 11, a planet gear set 12 and an eccentric shaft 13. The transmission gear shaft 11 is capable of receiving power while being driven to rotate thereby, which has an external gear 111 configured at a front end of the same. The planet gear set 12 comprises a plurality of planet gears 121 and a rotating part 122, in which the plural planet gears 121 is arranged surrounding and meshed to the external gear 111 of the transmission gear shaft 11; and the rotating part 122 is further configured with a plurality of pivot shafts 123, being arranged boring through the axes of the plural planet gears 121 corresponding thereto. In addition, the rotating part 122 is further configured with an internal gear 124 in a manner that the axial direction of the internal gear 124 is parallel to the pivot shafts 123. The eccentric shaft 13 is configured with an external gear 131 in a manner that the external gear 131 is meshed with the internal gear 124 of the rotating part 122. Therefore, when the transmission gear shaft 11 is being powered to rotate, the rotating external gear 111 will drive the planet gears 121 to rotate therewith; and then since the planet gears 121 are coupled to the rotating part 122, the rotating part 122 is being driven to rotate. Moreover, as the internal gear 124 of the rotating part 122 is meshed to the external gear 131 of the eccentric shaft 13, the rotating part 122 is able to drive the eccentric shaft 13 to rotate therewith. As shown in FIG. 2, the eccentric shaft 13 is configured with an eccentric pivot joint 132 which can be brought along to rotate in an eccentric manner when the eccentric shaft 13 is rotating at normal condition. However, it is noted that the rotation of the eccentric pivot joint 132 is restricted by the disposition of the sensing module 20.

Figure 3:
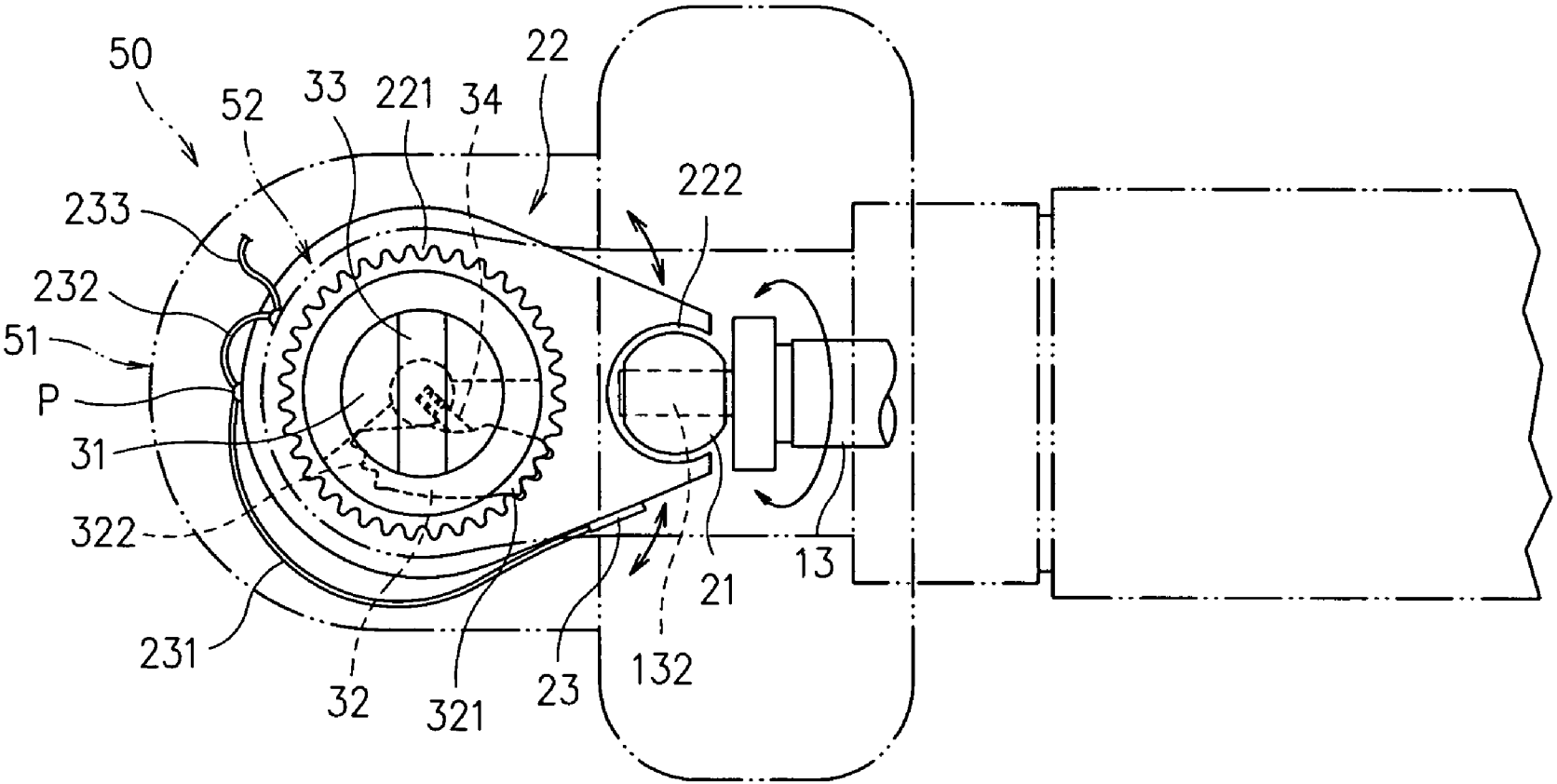
FIG. 3 shows an operating ratchet module according to the present invention.

As shown in FIG. 2 and FIG. 3, the sensing module is comprised of: a conversion part 21, a transmission part 22 and a sensor 23. The conversion part 21 is pivotally coupled to the eccentric pivot joint 132 of the eccentric shaft 13. The transmission part 22 is further configured with a gear 221 and an accommodation space 222, in which the gear 221 is meshed with the ratchet module 30, and the accommodation space 222 is used for receiving the conversion part 21. Thereby, when the eccentric shaft 13 is being driven to rotate, obviously the conversion part 21 should be driven to rotate in synchronization with the rotating eccentric shaft 13 since it is eccentrically coupled to the eccentric pivot joint 132. Nevertheless, since the conversion part 21, being received inside the accommodation space 222, is restricted inside the accommodation space 222 so that it can only move in a two-dimensional reciprocation motion. Moreover, as the gear 221 is meshed to the ratchet module 30, the gear 221 can also be move in similar two-dimensional reciprocation motion about the axis thereof. As for the sensor 23, it is being mounted on the transmission part 22 at an end thereof closer to the accommodation space 222 while being electrically connected to the transmission part 22 by a wire 231. Furthermore, also as the gear 221 is meshed to the ratchet module 30, the end of the transmission part 22 where the gear 221 is configured is treated as a fixed end; and the end of the transmission part 22 which is closer to the accommodation space 222 is treated as a free end since such end is going to be pressed and pushed by the conversion part 21 when it is being driven to move. The sensor 23 is electrically connected to a fixed point P of the transmission part 22 by a wire 231, where it is sequentially connected to the interior shell 52 and the control module 40 by the two wires 232, 233, so that the sensor 23 is able to detect the deformation of the transmission part 22 and thus generates an electric signal accordingly, e.g. a voltage signal, to be received by the control module 40. In this exemplary embodiment, the conversion part 21 is a flat structure having arc-like rims formed at the two sides thereof so that it can be fittedly received into the hollow column-like shaped accommodation space 222. However, the shapes of the conversion part 21 and the accommodation space 222 are nit limited thereby. In addition, the positioning of the fixed point P on the transmission part 22 is dependent upon the formation of the transmission part 22 that it should the spot on the transmission part 22 whose displacement is comparatively smaller when the transmission part 22 is moved.

The ratchet module 30 is comprised of a casing 31, a wedge block 32, a control button 33, an elastic component 34 and a working head 35. The wedge block 32 is received inside the casing 31 and has ratchets 321, 322 being arranged at the two sides thereof. The control button 33 is arranged on the casing 31 so as to be used for controlling the meshing of the ratchets 321, 322 with the gear 221 of the transmission part 22. The elastic component 34 is connected to the wedge block 32 and the control button 33 so as to be used for buffering the wedge block 32 and the control button 33 while enabling the ratchets 321, 322 of the wedge block 32 to mesh with the gear 221 of the transmission part 22 exactly. The working head 35, being arranged at the bottom of the casing 31, is usually formed as a cuboid so as to being inset into a tool with hollow rectangle joint, such as an hexagon screw driver 60 shown in FIG. 2. The hexagon screw driver 60 of FIG. 2 has a joint 61 formed at the top thereof which is provided for the working head 35 to inset therein. When the working head 35 is being driven to rotate, the hexagon screw driver 60 will be brought to rotate. It is noted that the working head 35 can also be inset into other types of tool, such as a Philip's head screw driver or slotted screw driver. Moreover, when the gear 221 is driven to move in the two-dimensional reciprocation motion about the axis thereof and thus the ratchet 321 is meshed with the gear 221, the hexagon screw driver 60 can be driven to rotate counterclockwisely; and when the ratchet 322 is meshed with the gear 221 by the control of the control button 33 during the two-dimensional reciprocation motion, the hexagon screw driver 60 can be driven to rotate clockwisely.

As shown in FIG. 1 and FIG. 2, the control module 40 is comprised of a display device 41, a power source 42 and a circuit device. The display device 41 can be a liquid crystal display device that is used for displaying the numerical signal as the indication of a torque. The power source 42 is for providing electricity to the power torque wrench. In this exemplary embodiment, the power source can be a battery or an external power source being connected to the torque wrench by a cable. The circuit device is electrically connected to the sensing module 20 and the display device 41.

From the above description relating to a digital power torque wrench of indirect transmission with reference to FIG. 1 to FIG. 3, it is known that power applying on the torque wrench can be transmitted from the eccentric driving module 10, the sensing module 20 and finally to the ratchet module 30 for driving the ratchet module 30 to rotate, whereas the rotating ratchet module 30 is able to drive an hexagon screw driver 60 coupled to the working head 35 to rotate and thus to be used for tightening a blot. In addition, such digital power torque wrench of indirect transmission is capable of not only performing a torque measurement in a rapid manner without being troubled by wear-and-tear and noise, but also capable of being maintained easily and manufactured with comparatively less cost. It is noted that when a blot is being gradually tightened, the rotating ratchet module 30 will be subject to an increasing resistance that is going to cause the free end of the transmission part 22 to deform slightly, and the slight deformation will be detected by the sensor 23 which will convert the detected deformation into an electric signal to be transmitted to the interior shell 52 through the fixed point P and finally to the control module 40 for signal processing. In The control module 40, the electric signal will be converted into a numerical signal as the indication of a torque which is then going to be displayed on the display device 41. The characteristic of the invention is that: the transmission of the deformation signal is enabled by the use of a fixing element, i.e. the interior shell, which is different from those conventional transmission method of using slip rings and brushes, so that the problems of wear-and-tear and noise can be avoided. It is noted that although the fixing element used in this embodiment is the interior shell, it is not limited thereby and thus can be selected to be any fixed part on the digital power torque wrench of indirect transmission of the invention.

In addition, the circuit device of the control module 40 can be designed dependent upon actual requirements in a manner that it can be designed with different precision designs, alarm systems of different predefined torques, or being configured with different torque units, e.g. N.m, lbf.ft and lbf.in, for adapting the torque wrench for different users, or being designed with the ability to display peak torque and to operate in a tracking mode. Moreover, the circuit device can be configured with memory and transmission functions for enabling the same to transmission data to a computer so that an electronic production management as well as torque data storage and inquire can be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A digital torque wrench with indirect power transmission coupling, comprising:

an eccentric driving module, for receiving power from a power source while transmitting said power, comprising a transmission gear shaft, for receiving power to rotate;

a planet gear set, meshing with the transmission gear shaft for rotating; and an eccentric shaft rotated by the planet gear set;

a sensing module, coupled to the eccentric driving module for receiving power from said eccentric driving module, comprising a conversion part, coupled to the eccentric shaft for enabling the eccentric shaft to be driven such that the conversion part is driven in a two-dimensional reciprocation by the rotating eccentric shaft, while simultaneously driving a transmission part to rotate about its gear axis;

the transmission part, configured with a gear and an accommodation space such that the gear is meshed with a ratchet module; the accommodation space is used for receiving the conversion part and restricting movement therein; and a sensor, being mounted on the transmission part and electrically connected to the control module so as to permit deformation of the transmission part and correspondingly send an electric signal to a control module;

the ratchet module driven to rotate, and coupled to the sensing module for receiving power from the sensing module; and the control module, electrically coupled to the sensing module for quantifying an electric signal from said sensing module.

2. The digital power torque wrench of claim 1, wherein the electric signal generated from the sensing module is transmitted to the control module by way of a fixed point.

3. The digital power torque wrench of claim 1, wherein the planet gear set further comprises:

a plurality of planet gears, each meshing with the transmission gear shaft; and a rotating part, pivotally coupled to the planet gear for enabling the gear to be driven to rotate thereby, and being configured with a gear meshing with a gear formed on the eccentric shaft in a manner that the eccentric is driven to rotate by the rotating part.

4. The digital power torque wrench of claim 3, wherein the plurality of planet gears are arranged surrounding and meshed to the outer rim of the transmission gear shaft.

5. The digital power torque wrench of claim 3, wherein the rotating part further comprises a pivot shaft, each being arranged boring through the axis of one of the at least one planet gear corresponding thereto.

6. The digital power torque wrench of claim 5, wherein the rotating part is further configured with an internal gear such that the axial direction of the internal gear is parallel to the pivot shaft; and the eccentric shaft is configured with an external gear such that the external gear is meshed with the internal gear of the rotating part.

7. The digital power torque wrench of claim 1, wherein the eccentric driving module power source is a system selected from the group consisting of a pneumatic power system or an electric power system.

8. The digital power torque wrench of claim 1, wherein the conversion part is a flat structure having arc-like rims formed at the two sides thereof; and the accommodation space is a hollow column-like shape.

9. The digital power torque wrench of claim 1, wherein the ratchet module further comprising:

a casing, a wedge block, being received inside the casing and having ratchets being arranged at the two sides thereof;

a control button, being arranged on the casing and used for controlling the meshing of the ratchets with the gear of the transmission part;

an elastic component, connected to the wedge block and the control button so as to provide buffering for the wedge block and the control button while enabling the ratchets of the wedge block to mesh with the gear of the transmission part exactly; and a working head, located at the bottom of the casing.

10. The digital power torque wrench of claim 9, wherein the working head is formed as a cuboid.

11. The digital power torque wrench of claim 1, wherein the control module quantifies the electric signal into a numerical signal representing a torque detected by the torque wrench.

12. The digital power torque wrench of claim 11, wherein the control module further comprises:

a display device, for displaying the torque of the numerical signal.

13. The digital power torque wrench of claim 12, wherein the display device is a liquid crystal display (LCD) device.

14. The digital power torque wrench of claim 12, wherein the control module further comprises:

a circuit device, electrically connected to the sensing module and the display device; and a power source, for providing electricity to the power torque wrench.

15. The digital power torque wrench of claim 14, wherein the power source is a source selected from the group consisting a battery or an external power source.

16. The digital power torque wrench of claim 1, further comprising: a shell, for receiving the eccentric driving module, the sensing module, the ratchet module and the control module.

17. The digital power torque wrench of claim 16, wherein the shell further comprises:

a control switch, electrically connected to the control module for controlling the input of power from the power source.

18. The digital torque wrench of claim 1, wherein said ratchet module is coupled to said sensing module for receiving power from said ratchet module while enabling the sensing module to detect a deformation from the ratchet module as it is rotating against an increasing resistance, and thus generating an electric signal in response to the detected deformation.

19. The digital torque wrench of claim 1, wherein said ratchet module is placed within said transmission part.

* * * * *